US006557471B2

(12) United States Patent
Hansson

(10) Patent No.: US 6,557,471 B2
(45) Date of Patent: May 6, 2003

(54) BLANKET WASHER FOR CLEANING CYLINDERS IN A PRINTING PRESS

(75) Inventor: Birger Hansson, Akarp (SE)

(73) Assignee: Baldwin Jimek AB (SE)

( * ) Notice: Subject to any disclaimer, the term of this patent is extended or adjusted under 35 U.S.C. 154(b) by 0 days.

(21) Appl. No.: 10/054,508

(22) Filed: Nov. 13, 2001

(65) Prior Publication Data

US 2002/0117065 A1 Aug. 29, 2002

Related U.S. Application Data

(63) Continuation of application No. PCT/SE00/00843, filed on May 3, 2000.

(30) Foreign Application Priority Data

May 12, 1999 (SE) ..... 9901729

(51) Int. Cl.[7] ..... B41L 41/00
(52) U.S. Cl. ..... 101/425; 101/424
(58) Field of Search ..... 101/425, 424, 101/423; 15/256.52, 256.51; 399/123, 357, 343

(56) References Cited

U.S. PATENT DOCUMENTS

| | | | | | |
|---|---|---|---|---|---|
| 4,920,880 | A | * | 5/1990 | Hara et al. | 101/425 |
| 4,981,078 | A | * | 1/1991 | Dettinger et al. | 101/424 |
| 4,986,182 | A | * | 1/1991 | Sawaguchi et al. | 101/425 |
| 5,105,740 | A | | 4/1992 | Loos et al. | 101/425 |
| 5,373,789 | A | | 12/1994 | Waizmann | 101/423 |
| 5,408,930 | A | | 4/1995 | Loos | 101/423 |
| 5,463,950 | A | * | 11/1995 | Cuir et al. | 101/425 |
| 6,341,558 | B1 | * | 1/2002 | Hanke et al. | 101/425 |

FOREIGN PATENT DOCUMENTS

| | | |
|---|---|---|
| EP | 0 291 745 | 4/1988 |
| EP | 0 299 193 | 6/1988 |
| GB | 2 280 640 | 6/1994 |

* cited by examiner

*Primary Examiner*—Anthony H. Nguyen
(74) *Attorney, Agent, or Firm*—St. Onge Steward Johnston & Reens LLC

(57) ABSTRACT

A blanket washer for the cleaning of cylinders in a printing press comprises a cleaning unit containing rolls for a cleaning cloth, which is to be transferred past an external pad unit on the cleaning unit. The cleaning unit has a front profile for the mounting of one or more pad units in different positions thereon.

7 Claims, 3 Drawing Sheets

Fig. 5 A
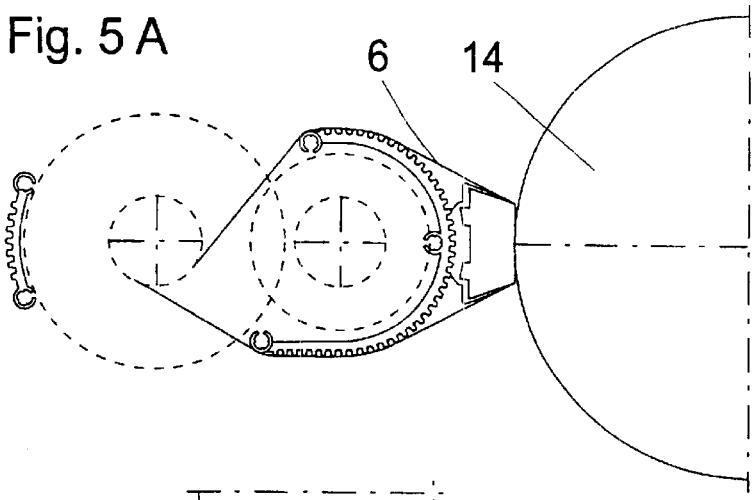
Fig. 5 B
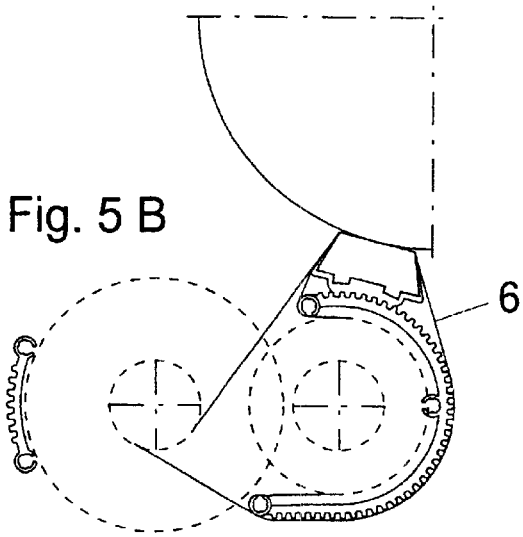
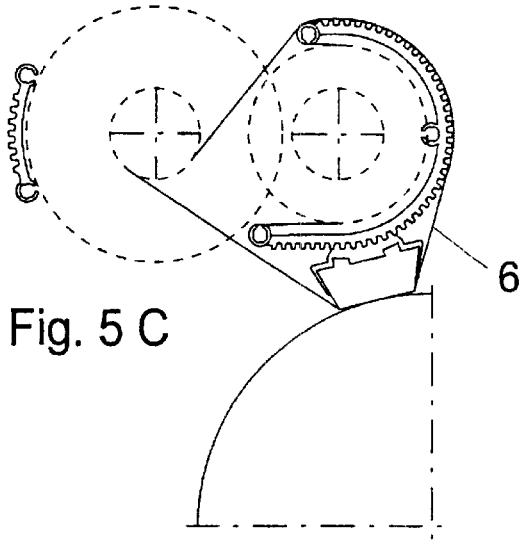
Fig. 5 C
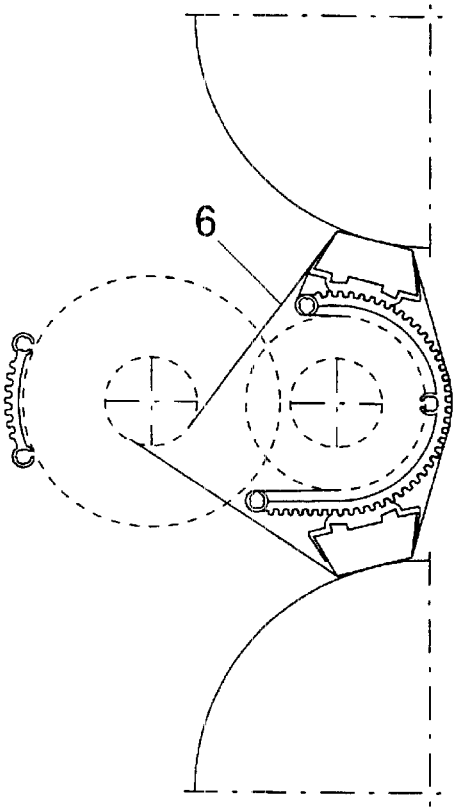
Fig. 5 D

BLANKET WASHER FOR CLEANING CYLINDERS IN A PRINTING PRESS

This application is a continuation of pending International Patent Application PCT/SE00/00843 filed May 3, 2000, which designates the United States and claims priority from Swedish Patent Application 9901729-5 filed on May 12, 1999.

FIELD OF THE INVENTION

The present invention relates to a blanket washer for the cleaning of cylinders in a printing press, the blanket washer comprising a cleaning unit containing rolls for a cleaning cloth, which is to be transferred past an external pad unit on the cleaning unit.

BACKGROUND OF THE INVENTION

A blanket washer of the kind referred to above is for example shown and described in EP-B-0 613 421. This blanket washer has a pad unit integrally provided at its front end, and the whole blanket washer may be transferred along its central longitudinal axis for bringing its cleaning cloth, transferred over the pad unit, into and out of cleaning engagement with a cylinder, for example a blanket cylinder, in a printing press.

A blanket washer of this kind does not have the desired flexibility for many uses. In many modern printing presses the space available for a blanket washer may be very limited, and it may for example be difficult to use a blanket washer with a fixed, central pad unit. Also, it may be desired to concurrently or alternatively clean more than one cylinder with one blanket washer for enhanced flexibility.

SUMMARY THE INVENTION

A blanket washer of the kind referred to with a greatly improved flexibility may according to the invention be attained in that means are provided for mounting one or more pad units in different positions on the cleaning unit.

Preferably, the cleaning unit has a front profile for the mounting of one or more pad units in different positions.

Hereby, a pad unit may be mounted obliquely in relation to the central longitudinal axis of the cleaning unit, if the available space is too limited for a centrally mounted pad unit. Also, two or even three cylinders may be cleaned by one blanket washer, provided with two or three pad units, respectively.

The front profile of the cleaning unit is preferably curved, and each pad unit has a corresponding curvature at its back side for abutment against the front profile. Firm positions for the pad units may hereby be attained in that the front profile and the back side of the pad units have corresponding longitudinal serrations.

The pad units may be attached to the front profile by means of for example screwing, adhesion, welding or snap-fastening, preferably by means of self-threading screws.

BRIEF DESCRIPTION OF THE DRAWINGS

The invention will be described in further detail below under reference to the accompanying drawings, in which

FIGS. 5A–D illustrate different practical uses of a blanket washer according to the invention.

DETAILED DESCRIPTION OF DRAWINGS

Figure 1A:
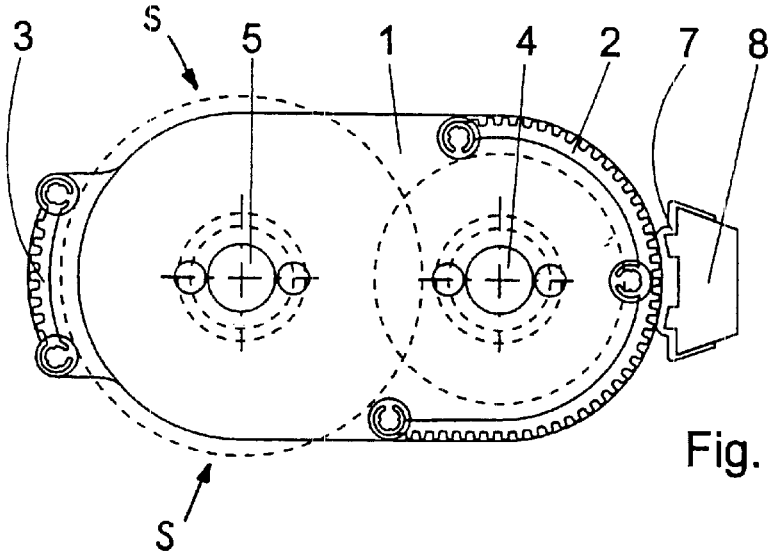
FIG. 1A is a side view of a blanket washer according to the invention and FIG. 1B is a top view of an end piece therefore.
Figure 1B:
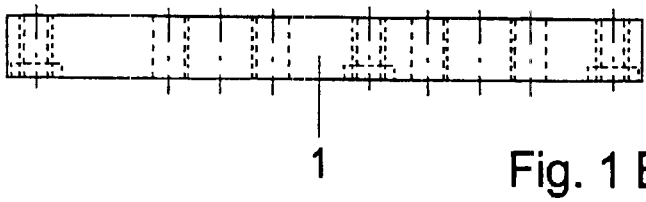
Figure 2A:
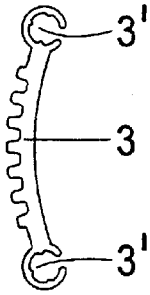
FIGS. 2A–C are side views of profiles for use in a blanket washer according to the invention.
Figure 2B:
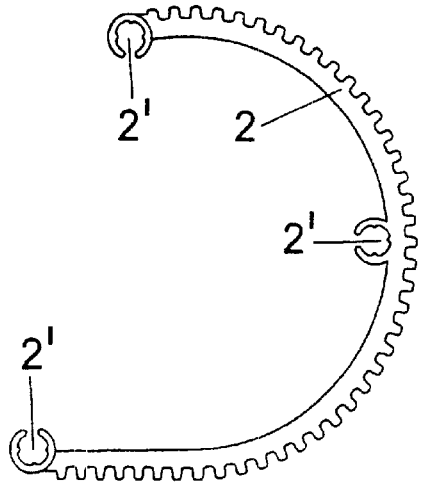
Figure 2C:
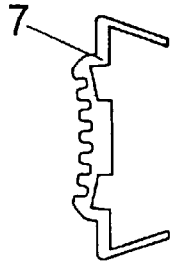
Figure 3:
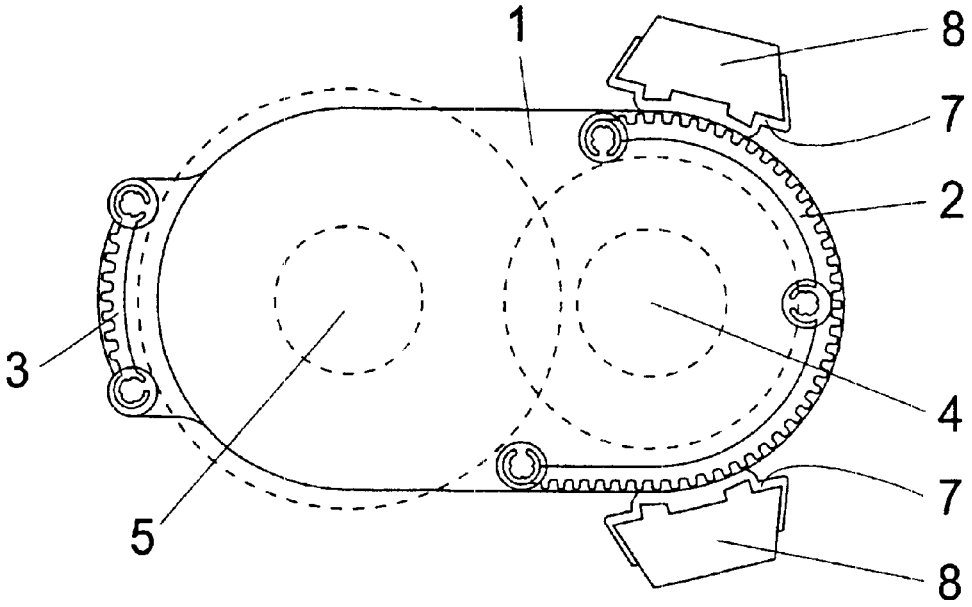
FIG. 3 is a side view corresponding to FIG. 1 of an alternative use of a blanket washer according to the invention.

A blanket washer according to the invention comprises basically two end pieces 1 shown in FIG. 1B (but also in FIGS. 1A and 3). The end pieces 1 may be manufactured of aluminium, but other materials can also be used. A number of longitudinal members to be described are arranged between the end pieces 1 so as together to form the blanket washer.

The most important of these longitudinal members is a front profile 2. Optionally, there may also be a back profile 3. In a practical embodiment, however, no back profile 3 is provided. The end pieces 1 are attached, preferably by screws in screw fittings 2' and 3', to the profiles 2 and 3 so as to form a cleaning unit in the form of a longitudinal box or cassette to be arranged in a way not further illustrated or described in a printing press in the vicinity of a cylinder to be cleaned.

The front and back profiles 2 and 3 have a length roughly corresponding to the length of a cylinder to be cleaned, which in practice may mean a length of for example 1.8 m. The profiles are preferably made of aluminium, but other materials may also be used. The purpose of the back profile 3 is mainly to stabilize the cleaning unit, and if a satisfactory stability is attained without it, it may be dispensed with. An advantage is hereby that admittance to the interior of the cleaning unit is simplified.

Two shafts 4 and 5 are further journalled for rotation in the end pieces 1 for forming a reeling-off roll 4 and a reeling-on roll 5 with a cleaning cloth 6 (FIG. 5). In a way not illustrated or described, either or both of the shafts are imparted a rotation for transferring the cleaning cloth 6 from the reeling-off roll 4 to the reeling-on roll 5. Means for imparting rotation to the shafts may preferably be arranged external of the cleaning unit for making it as simple as possible.

At its external side the front profile 2 has a longitudinal serration or the like. A pad profile 7 has at its backside a corresponding serration and the same curvature as the front profile 2, so that when brought into engagement with the front profile 2, the pad profile 7 will attain a well-defined position.

The pad profile 7 has a length corresponding to that of the other profiles 2 and 3 and thus of the cylinder to be cleaned. It may be made of aluminium or any other suitable material.

At its front side the pad profile 7 has holding means for a pad 8, so that a pad unit 7, 8 is formed. The pad 8 itself does not form any part of the present invention and may be of different materials and shapes depending on the intended cleaning purpose. Normally, it is made of a compressible material. If desired, it may be provided with means for transferring cleaning liquid to the cleaning cloth 6 passing over it. This may for example be accomplished by a longitudinal conduit, which extends through the pad, has holes extending to the front pad surface, and is connected to a source for cleaning liquid.

When a desired location for a pad profile 7 on the front profile 2 has been found, the pad profile 7 is attached in a suitable way, such as by adhesion, welding or snap-fastening, but preferably by screwing. Holes may be drilled through the pad profile 7 and into the front profile 2 and self-threading screws be used for fastening the two parts together. After this fastening, the pad 8 may be put in proper position.

The front profile 2 may preferably, as is depicted, extend 180° around the reeling-off roll 4. At its lower side it may as shown be somewhat extended for providing added stability to the cleaning unit, of which it is a part. Enough space "S" (FIG. 1A) must be left between the front profile 2 and the back profile 3 for allowing removal of a full reeling-on roll 5 after using up the cleaning cloth 6 and insertion of a new reeling-off roll 4 with a non-used cleaning cloth 6 thereafter.

Figure 4:
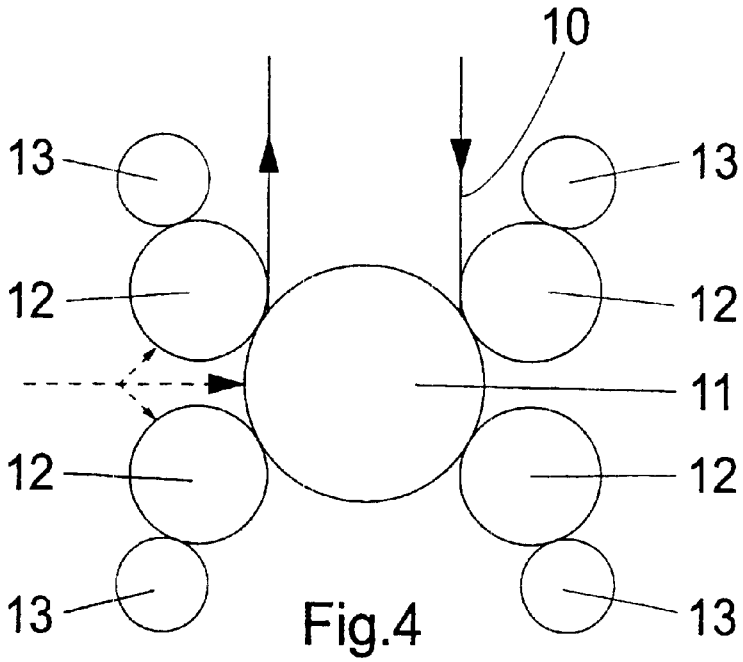
FIG. 4 is a very schematic illustration of a printing unit in a printing press.

An example of a printing unit for printing with four colours on a paper web 10 is schematically shown in FIG. 4. The paper web 10 is laid around an impression cylinder 11. In contact therewith are four blanket cylinders 12 for the four colours, and in contact with these blanket cylinders 12 are four plate cylinders 13. As is well known in the art, further cylinders are needed in the printing unit, for example for supplying printing ink to the plate cylinders 13.

Conventionally, blanket washers are used for cleaning blanket cylinders, but they may equally well be used also for cleaning for example impression cylinders and plate cylinders. As is illustrated by dashed arrows in FIG. 4, it may be desired to clean two blanket cylinders 12 and possibly also the impression cylinder 11.

This is made possible by the blanket washer according to the invention, because the front profile 2 may be provided with one or more pad units 7, 8 at different locations.

In FIG. 5A a pad unit 7, 8 is centrally arranged on the front profile 2 (along the central longitudinal axis of the cleaning unit) and is to cleaningly apply its cloth 6 on the surface of a cylinder 14. In FIGS. 5B and 5C the pad unit 7, 8 is upwardly and downwardly offset, respectively, for cleaning the cylinder 14 arranged above and below the cleaning unit, respectively. In FIG. 5D, finally, the front profile 2 is provided with two pad units 7, 8 for cleaning co-operation with two cylinders 14. Provided that certain geometrical conditions were met, three pad units could be arranged on one front profile for cleaning three cylinders at the same time.

The fact that in FIGS. 5A–D the web 6 seems to both stem from and end on the reeling-on roll 5 is only to be seen as an indication that the cloth 6 can move in either direction over the pad unit(s) 7, 8.

What is claimed is:

1. A blanket washer for the cleaning of a cylinder in a printing press, the blanket washer comprising:

a pad unit having a front side and a back side;

a cleaning unit containing rolls for a cleaning cloth adapted to pass over the front side of the pad unit for cleaning of the cylinder, the cleaning unit including a front profile having a curved outer surface; and said back side of the pad unit having a curvature corresponding to the curvature of the outer surface of the front profile, and the pad unit adapted for mounting at different positions to the cleaning unit with the back side abutting against the outer surface of the front profile.

2. A blanket washer according to claim 1 including a plurality of pad units mounted at the front profile.

3. A blanket washer according to claim 1, wherein the front profile and the back side of the pad unit have corresponding longitudinal serrations.

4. A blanket washer according to claim 1, wherein the pad unit is adapted to mount to the front profile by means of screwing, adhesion, welding or snap-fastening.

5. A blanket washer according to claim 4, wherein the pad unit is mounted to the front profile by means of self-threading screws.

6. A blanket washer according to claim 5, wherein the pad unit includes a pad, over which the cleaning cloth is transferred.

7. A blanket washer according to claim 1, wherein the cleaning unit includes a space for removal and insertion of cleaning cloth rolls.

* * * * *